US011147373B1

(12) United States Patent
Ramsey

(10) Patent No.: US 11,147,373 B1
(45) Date of Patent: Oct. 19, 2021

(54) ADULT PRODUCT STORAGE ASSEMBLY

(71) Applicant: Bryan Ramsey, San Antonio, TX (US)

(72) Inventor: Bryan Ramsey, San Antonio, TX (US)

( * ) Notice: Subject to any disclaimer, the term of this patent is extended or adjusted under 35 U.S.C. 154(b) by 0 days.

(21) Appl. No.: 16/841,761

(22) Filed: Apr. 7, 2020

(51) Int. Cl.

| | |
|---|---|
| ***A47B 88/00*** | (2017.01) |
| ***A47B 88/487*** | (2017.01) |
| ***E06B 3/38*** | (2006.01) |
| ***H05B 3/06*** | (2006.01) |
| ***H04R 1/02*** | (2006.01) |

(52) U.S. Cl.
CPC ..... *A47B 88/487* (2017.01); *E06B 3/385* (2013.01); *H04R 1/02* (2013.01); *H05B 3/06* (2013.01); *E05Y 2900/20* (2013.01); *H04R 2201/025* (2013.01)

(58) Field of Classification Search
CPC ..... A47B 88/403; A47B 46/00; A47B 2220/0075; A47B 2220/0077; A47B 88/487; H04R 1/02; H04R 2201/025; E06B 3/385; H05B 3/06; E05Y 2900/20
USPC ..... 312/283, 287, 289, 223.5
See application file for complete search history.

(56) References Cited

U.S. PATENT DOCUMENTS

| | | | | |
|---|---|---|---|---|
| 3,784,270 | A | 1/1974 | DeLapp | |
| 3,839,622 | A | 10/1974 | Mastin | |
| 4,918,290 | A | 4/1990 | DeMars | |
| 5,733,035 | A | 3/1998 | Spencer et al. | |
| 6,005,227 | A | 12/1999 | Pappas | |
| 6,982,399 | B1 * | 1/2006 | Hunts | A47K 10/06 219/400 |
| D766,021 | S | 9/2016 | Burden | |
| 9,608,455 | B2 | 3/2017 | Byrne et al. | |
| 2011/0062897 | A1 * | 3/2011 | Li | H05B 47/105 315/362 |
| 2011/0110540 | A1 * | 5/2011 | Mispelkamp | A47B 81/06 381/120 |
| 2011/0284580 | A1 * | 11/2011 | Boettcher | A47J 47/01 222/108 |
| 2012/0312196 | A1 | 12/2012 | Newkirk | |
| 2015/0022067 | A1 * | 1/2015 | Lee | A47B 88/40 312/236 |
| 2015/0091389 | A1 * | 4/2015 | Byrne | H02J 50/90 307/104 |
| 2017/0099945 | A1 * | 4/2017 | Meads | A47B 67/005 |

(Continued)

FOREIGN PATENT DOCUMENTS

DE 202019105825 U1 * 11/2019 ..... A47B 79/00

OTHER PUBLICATIONS

English translation of Voelker (DE202019105825) (Year: 2021).*

*Primary Examiner* — Matthew W Ing

(57) ABSTRACT

An adult product storage assembly includes a cabinet and a plurality of rollers that is each coupled to the cabinet to roll along a support surface. A pair of front drawers is each slidably positioned in the cabinet to store objects. A plurality of dispensers is positioned in the cabinet and of the dispensers stores a personal lubricant to dispense the personal lubricant for a user. A plurality of side drawers is each slidably coupled to the cabinet. Each of the side drawers is slidable outwardly from the cabinet for accessing each of the side drawers and each of the side drawers is recessable into the cabinet for storing the side drawers. A pair of speakers is each coupled to the cabinet to emit audible sound outwardly therefrom. A subwoofer is positioned in the cabinet to emit audible sounds at the lower frequency range of human hearing.

14 Claims, 7 Drawing Sheets

(56) References Cited

U.S. PATENT DOCUMENTS

| | | | | |
|---|---|---|---|---|
| 2017/0172296 | A1* | 6/2017 | Monteiro | F16B 12/34 |
| 2018/0106439 | A1* | 4/2018 | Dhali | F21S 4/28 |

* cited by examiner

ADULT PRODUCT STORAGE ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for discretely storing adult products and personal lubricants.

BRIEF SUMMARY OF THE INVENTION

An embodiment of the disclosure meets the needs presented above by generally comprising a cabinet and a plurality of rollers that is each coupled to the cabinet to roll along a support surface. A pair of front drawers is each slidably positioned in the cabinet to store objects. A plurality of dispensers is positioned in the cabinet and of the dispensers stores a personal lubricant to dispense the personal lubricant for a user. A plurality of side drawers is each slidably coupled to the cabinet. Each of the side drawers is slidable outwardly from the cabinet for accessing each of the side drawers and each of the side drawers is recessable into the cabinet for storing the side drawers. A pair of speakers is each coupled to the cabinet to emit audible sound outwardly therefrom. A subwoofer is positioned in the cabinet to emit audible sounds at the lower frequency range of human hearing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
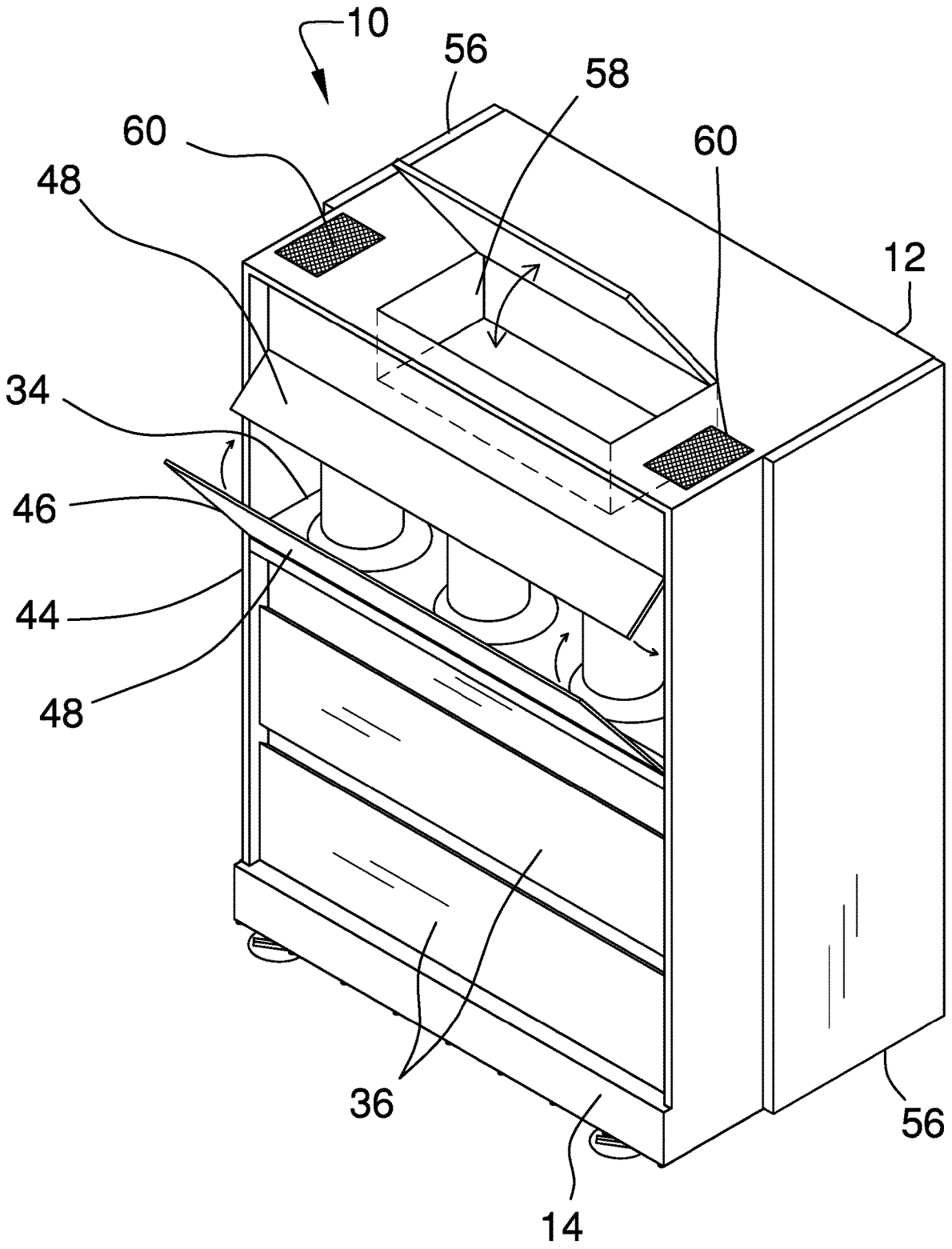
FIG. 1 is a front perspective view of an adult product storage assembly according to an embodiment of the disclosure.
Figure 2:
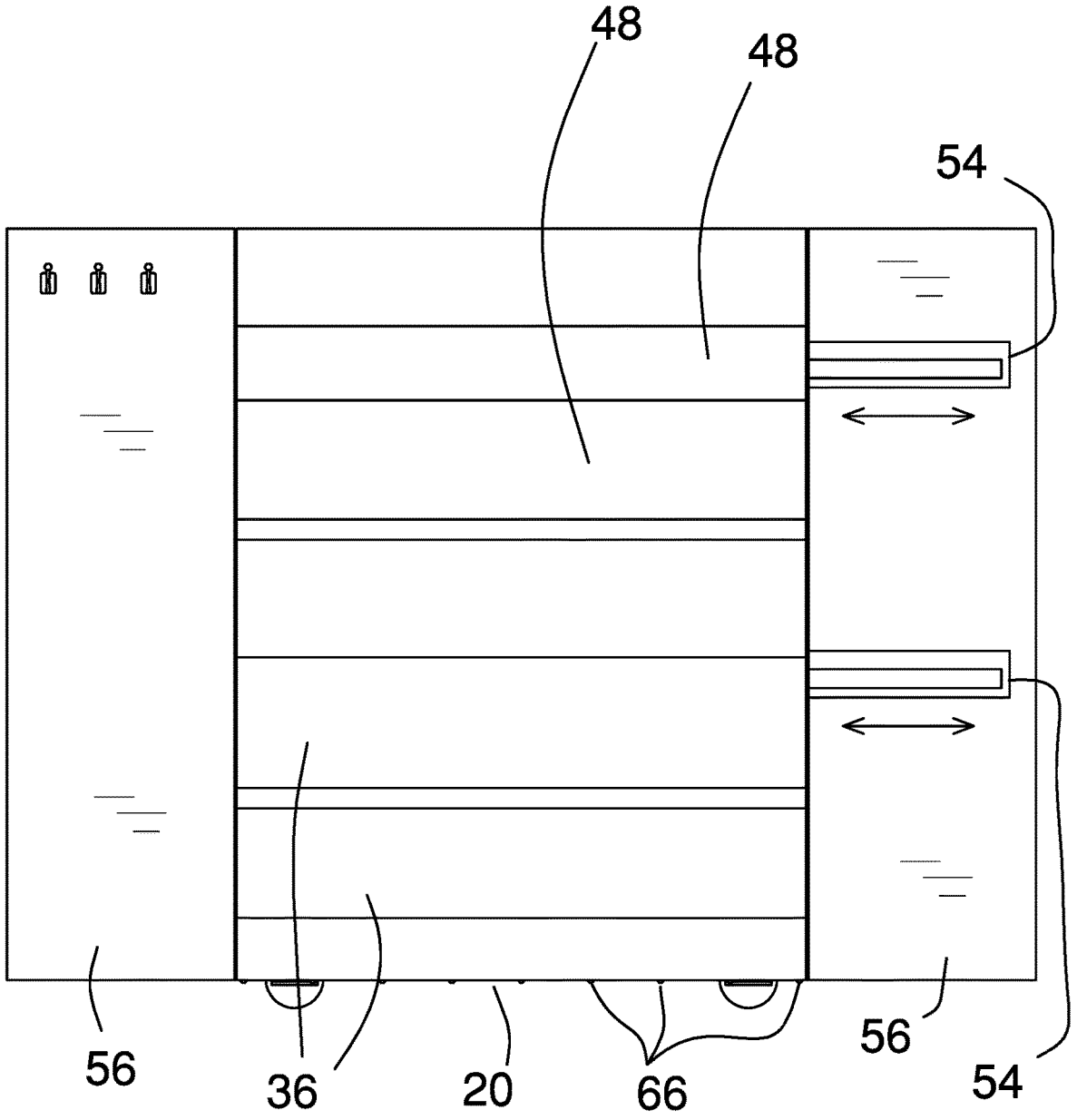
FIG. 2 is a front view of an embodiment of the disclosure showing a plurality of side drawers being opened.
Figure 3:
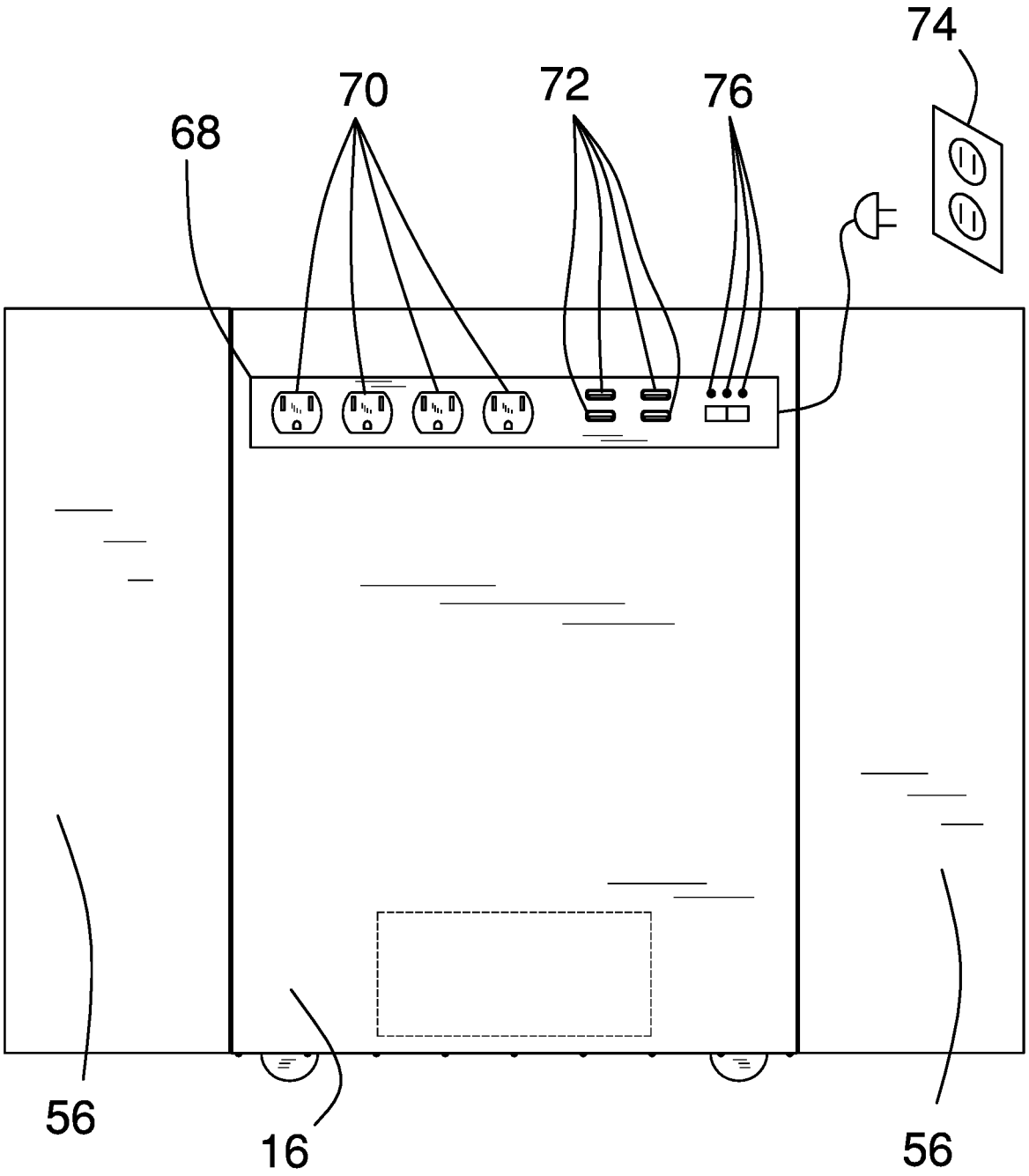
FIG. 3 is a back view of an embodiment of the disclosure.
Figure 4:
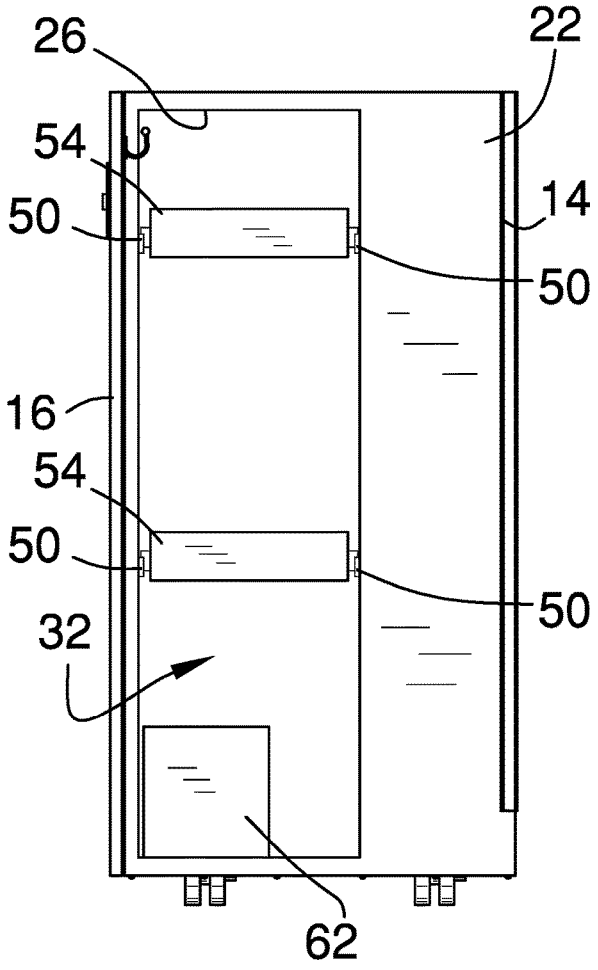
FIG. 4 is a left side view of an embodiment of the disclosure.
Figure 5:
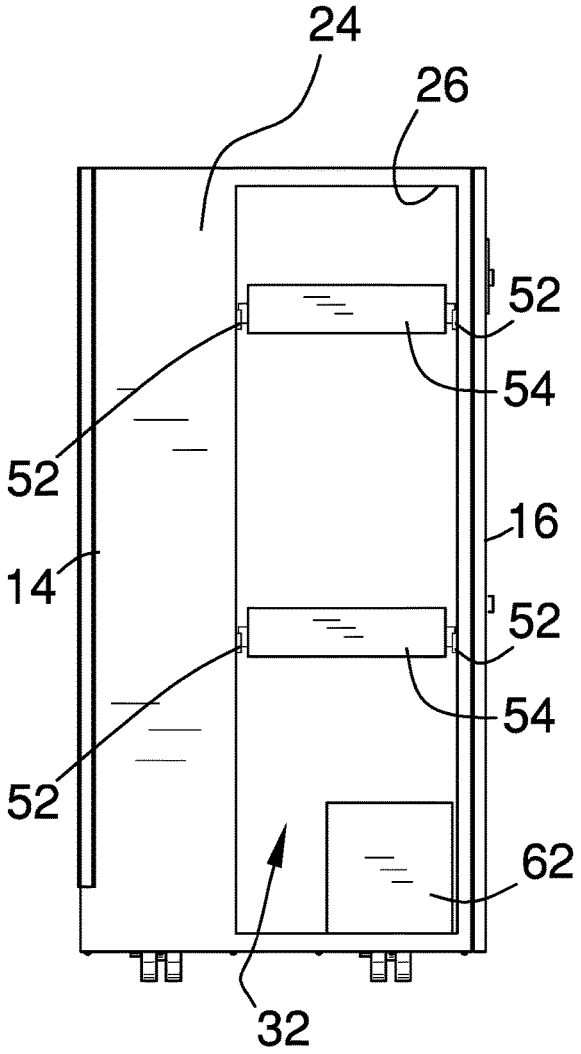
FIG. 5 is a right side view of an embodiment of the disclosure.
Figure 6:
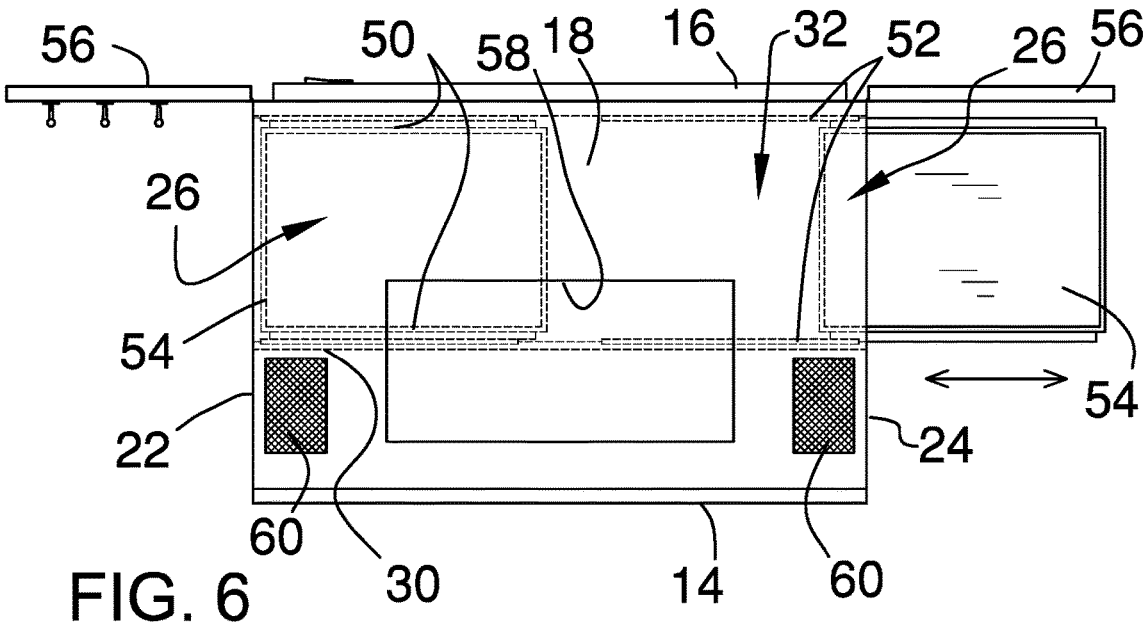
FIG. 6 is a top phantom view of an embodiment of the disclosure.
Figure 7:
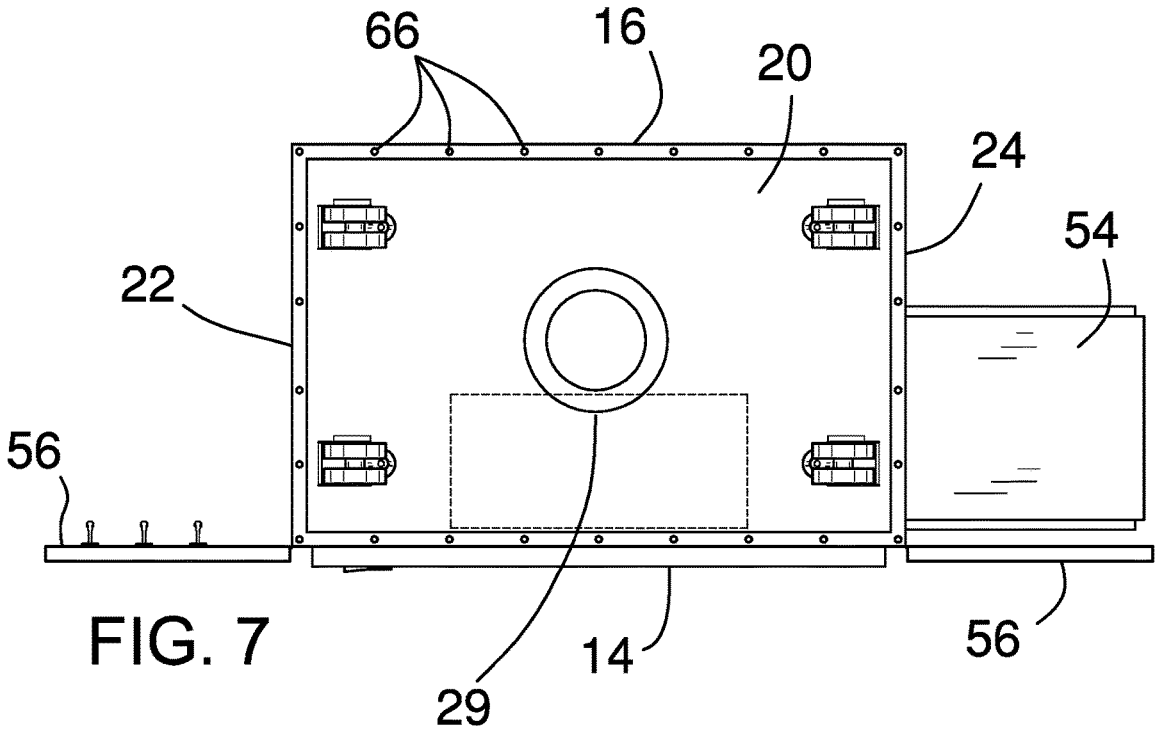
FIG. 7 is a bottom phantom view of an embodiment of the disclosure.
Figure 8:
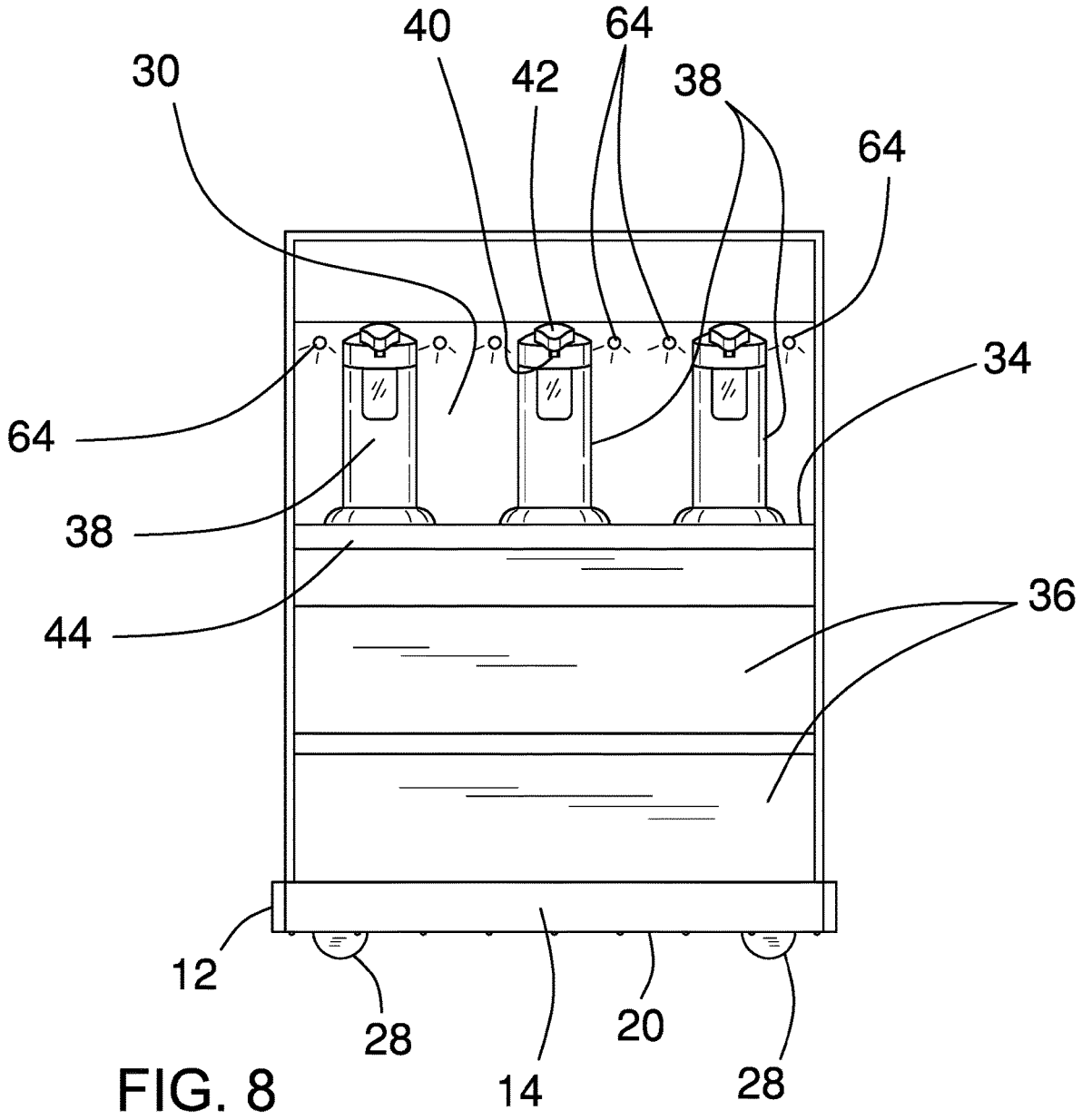
FIG. 8 is a front view of an embodiment of the disclosure.
Figure 9:
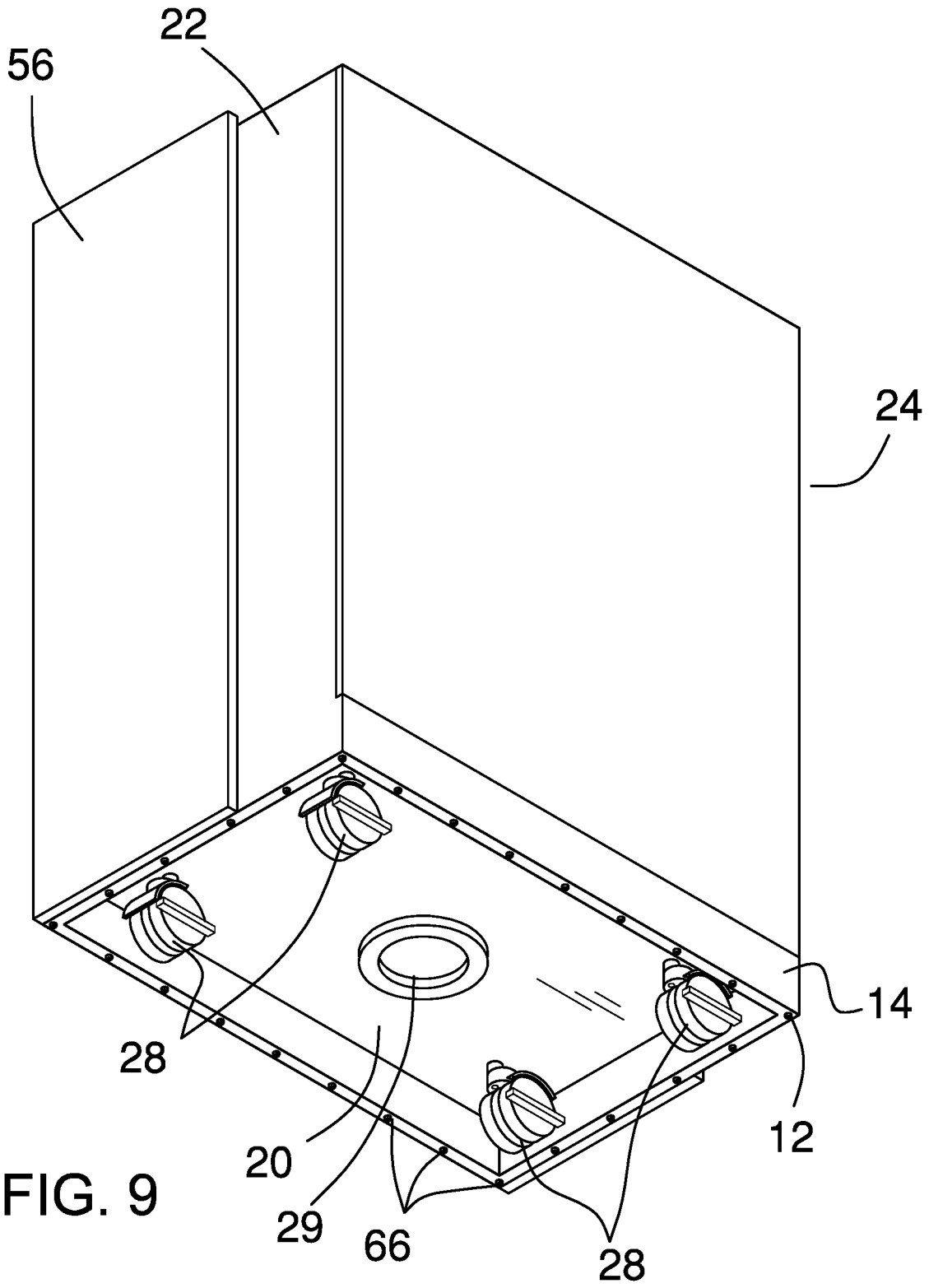
FIG. 9 is a bottom perspective view of an embodiment of the disclosure.

With reference now to the drawings, and in particular to FIGS. 1 through 9 thereof, a new storage device embodying the principles and concepts of an embodiment of the disclosure and generally designated by the reference numeral 10 will be described.

As best illustrated in FIGS. 1 through 9, the adult product storage assembly 10 generally comprises a cabinet 12 has a forward side 14, a rear side 16, a top side 18, a bottom side 20, a first lateral side 22 and a second lateral side 24. The forward side 14 is open to access an interior of the cabinet 12 and each of the first 22 and second 24 lateral sides has an opening 26 extending into the interior of the cabinet 12. The opening 26 on each of the first 22 and second 24 lateral sides extends between the top 18 and bottom 20 sides and the opening 26 in each of the first 22 and second 24 lateral sides is aligned with the rear side 16.

A plurality of rollers 28 is each rollably coupled to the cabinet 12 to roll along a support surface 27. Each of the rollers 28 is positioned on the bottom side 20 of the cabinet 12 and each of the rollers 28 may comprise a locking caster or the like. As is most clearly shown in FIGS. 7 and 9, a rotating pedestal 29 may be rotatably coupled to the bottom side 20 of the cabinet 12. The rotating pedestal 29 may be rotatable about an axis extending through the top side 18 and the bottom side 20 of the cabinet. Additionally, the rotating pedestal 29 may rest upon the support surface 27 for rotating the cabinet 12 about the axis extending through the top side 18 and the bottom side 20.

A wall 30 is positioned within the cabinet 12. Moreover, the wall 30 is positioned between the forward side 14 and the opening 26 in each of the first 22 and second 24 lateral sides to define a side drawer space 32 between the wall 30 and the rear side 16 of the cabinet 12. A shelf 34 is positioned in the cabinet 12, the shelf 34 is horizontally oriented in the cabinet 12 and is positioned between the top side 18 and the bottom side 20. A pair of front drawers 36 is each slidably positioned in the cabinet 12 to store objects. The objects may be adult intimate toys or the like that can be discretely stored in the front drawers 36. Each of the front drawers 36 is positioned between the shelf 34 and the bottom side 20 and each of the front drawers 36 extends outwardly through the forward side 14 of the cabinet 12 when the front drawers 36 are opened.

A plurality of dispensers 38 provided and each of the dispensers 38 stores a personal lubricant. Each of the dispensers 38 is positioned on the shelf 34 and each of the dispensers 38 has a dispensing nozzle 40 and a pump 42. The pump 42 on each of dispensers 38 is manipulated to dispense the personal lubricant from the nozzle 40 on the dispensers 38. In this way each of dispensers 38 can dispense the personal lubricant for a user. Each of the dispensers 38 may be manually operated fluid dispenser of any conventional design.

A drip tray 44 is coupled to the shelf 34 and the drip tray 44 is positioned beneath the nozzle 40 on each of the dispensers 38. In this way the drip tray 44 can capture personal lubricant that drips from the nozzle 40 in each of the dispensers 38. The drip tray 44 is positioned on a forward edge 46 of the shelf 34. A pair of folding doors 48 is each pivotally coupled to the forward side 14 of the cabinet and each of the folding doors 48 is horizontally oriented. Each of the folding doors 48 is positionable in a closed position having each of the folding doors concealing the plurality of dispensers 38. Additionally, each of the folding doors is positionable in an open position to expose the dispensers 38. The folding doors 48 may be recessed into the cabinet 12 when the folding doors are in the open position.

A plurality of first tracks 50 is each coupled to respective ones of the rear side 16 of the cabinet 12 and the wall 30 in the cabinet 12. Each of the first tracks 50 is horizontally oriented and is positioned in the side drawer space 32 in the cabinet 12. Moreover, each of the first tracks 50 is aligned with the opening 26 in the first lateral side 22 of the cabinet 12. A plurality of second tracks 52 is each coupled to respective ones of the rear side 16 of the cabinet 12 and the wall 30 in the cabinet 12. Each of the second tracks 52 is horizontally oriented and is positioned in the side drawer space 32 in the cabinet 12. Moreover, each of the second tracks 52 is aligned with the opening 26 in the second lateral side 24 of the cabinet 12.

A plurality of side drawers 54 is each slidably coupled to the cabinet 12. Each of the side drawers 54 is slidable outwardly from the cabinet 12 for accessing each of the side drawers 54. Additionally, each of the side drawers 54 can be recessed into the cabinet 12 for storing the side drawers 54. Each of the side drawers 54 slidably engages a respective pair of the first 50 and second 52 tracks. Moreover, each of the side drawers 54 is slidably outwardly from the opening 26 in a respective one of the first 22 and second 24 lateral sides of the cabinet 12. The side drawers 54 are vertically distributed between the top 18 and bottom 20 sides of the cabinet 12.

A pair of doors 56 is each hingedly coupled to the cabinet 12. Each of the doors 56 is positioned on a respective one of the first 22 and second 24 lateral sides of the cabinet 12. Additionally, each of doors 56 closes the opening 26 in the respective first 22 and second 24 lateral sides when the doors 56 are closed. A towel warmer 58 is coupled to the cabinet 12 to contain and warm towels. The towel warmer 58 is recessed into the top side 18 of the cabinet 12. The towel warmer 58 may be an electronic towel warmer of any conventional design. As is most clearly shown in FIG. 1, a towel door 59 is hingedly coupled to the top side 18 for opening and closing the towel warmer 58.

A pair of speakers 60 is each coupled to the cabinet 12 to emit audible sound outwardly therefrom. Each of the speakers 60 is recessed into the top side 18 of the cabinet 12. Additionally, each of the speakers 60 is positioned on opposite sides of the towel warmer 58 from each other. Each of the speakers 60 can be placed in wireless electrical communication with an audio source. Moreover, each the speakers 60 may be Bluetooth speakers or other type of electronic speaker that has wireless communication capabilities. A subwoofer 62 is positioned in the cabinet 12 to emit audible sounds at the lower frequency range of human hearing. The subwoofer 62 can be placed in wireless electrical communication with the audio source. Additionally, the subwoofer 62 may be a Bluetooth subwoofer or other type of electronic subwoofer that has wireless communication capabilities.

A plurality of first light emitters 64 is each coupled to the cabinet 12 to emit light outwardly therefrom. Each of the first light emitters 64 is positioned within the cabinet 12 and each of the first light emitters 64 is directed toward the forward side 14 of the cabinet 12. The first light emitters 64 are horizontally distributed along the wall 30 in the cabinet 12. A plurality of second light emitters 66 is each coupled to the cabinet 12 to emit light outwardly therefrom. Each of the second light emitters 66 is positioned on the bottom side 20 of the cabinet 12 to emit light downwardly onto the support surface. Moreover, the second light emitters 66 are spaced apart from each other and are distributed around a perimeter of the bottom side 20. Each of the first 64 and second 66 light emitters may comprise an LED or the like that has an adjustable intensity.

A power supply 68 is coupled to the cabinet 12. Each of the towel warmer 58, the first light emitters 64, the second light emitters 66, the speakers 60 and the subwoofer 62 is electrically coupled to the power supply 68. The power supply 68 is positioned on the rear side 16 of the cabinet 12 and the power supply 68 has a plurality of female electrical outlets 70 thereon. In this way various electrical devices can be plugged into the power supply 68. The power supply 68 has a plurality of charge ports 72 recessed therein for charging electronic devices. Additionally, the power supply 68 is electrically coupled to a power source 74 comprising a female electrical outlet. A plurality of control buttons 76 may be positioned on the power supply 68 for controlling operational parameters of the towel warmer 58, the first 64 and second 66 light emitters, the speakers 60 and the subwoofer 62.

As is most clearly shown in FIG. 1, a detachable user interface 78 may be provided the detachable user interface 78 may be coupled to the cabinet 12. Moreover, the detachable user interface 78 may be in electrical communication with each the speakers 60, the subwoofer 62, each of the first light emitters 64, each of the second light emitters 66 and the towel warmer 58 via a radio frequency receiver or the like. The detachable user interface 78 may be removable from the cabinet 12 to facilitate the user to remotely control the speakers 60, the subwoofer, the first light emitters 64, the second light emitters 66 and the towel warmer 58. The detachable user interface 78 may be positionable between a recessed position and a lifted position with respect to the top side 16 of the cabinet 12.

In use, adult toys and intimate accessories are stored in the front drawers 36 and the side drawers 54. In this adult toys and intimate accessories are hidden from view when the bi-fold doors 48 and the doors 56 are closed. Each of the dispensers 38 is filled with a personal lubricant of a user's choice. In this way the personal lubricants can be stored in a discrete manner. Each of the bi-fold doors 48 and the doors 56 are opened to access the front drawers 36 and the side drawers 54. Additionally, each of the speakers 60 and the subwoofer 62 can be connected to the audio source for playing music or any other sounds. Each of the first 64 and second 66 light emitters can be turned on at a selected intensity. In this way the speakers 60, the subwoofer 62, the first light emitters 64 and the second light emitters 66 enhance the environment for adult sexual activities for one or more users.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adult product storage assembly being configured to store personal lubricants and adult toys, said assembly comprising:

a cabinet, said cabinet having a top side;

a plurality of rollers, each of said rollers being coupled to said cabinet wherein each of said rollers is configured to roll along a support surface;

a shelf being positioned in said cabinet;

a pair of front drawers, each of said front drawers being slidably positioned in said cabinet wherein each of said front drawers is configured to store objects;

a plurality of dispensers each being configured to store a personal lubricant, each of said dispensers being positioned on said shelf wherein each of dispensers is configured to dispense the personal lubricant for a user;

a plurality of side drawers, each of said side drawers being slidably coupled to said cabinet, each of said side drawers being slidable outwardly from said cabinet for accessing each of said side drawers, each of said side drawers being recessable into said cabinet for storing said side drawers;

a towel warmer being coupled to said cabinet wherein said towel warmer is configured to contain and warm towels, said towel warmer being recessed into said top side of said cabinet;

a towel door being hingedly coupled to said top side of said cabinet along a distal edge of said towel door relative to a front edge of said top side wherein said towel door opens facing said front edge of said top side of said cabinet;

a pair of speakers, each of said speakers being coupled to said cabinet wherein each of said speakers is configured to emit audible sound outwardly therefrom;

a subwoofer being positioned in said cabinet wherein said subwoofer is configure to emit audible sounds at the lower frequency range of human hearing;

a plurality of first light emitters, each of said first light emitters being coupled to said cabinet wherein each of said first light emitters is configured to emit light outwardly therefrom; and a plurality of second light emitters, each of said second light emitters being coupled to said cabinet wherein each of said second light emitters is configured to emit light outwardly therefrom.

2. The assembly according to claim 1, wherein said cabinet has a forward side, a rear side, a bottom side, a first lateral side and a second lateral side, said forward side being open to access an interior of said cabinet, each of said first and second lateral sides having an opening extending into said interior of said cabinet, said opening on each of said first and second lateral sides extending between said top and bottom sides, said opening in each of said first and second lateral sides being aligned with said rear side.

3. The assembly according to claim 2, further comprising a wall being positioned within said cabinet, said wall being positioned between said forward side and said opening in each of said first and second lateral sides to define an side drawer space between said wall and said rear side of said cabinet.

4. The assembly according to claim 3, wherein:

said shelf is horizontally oriented in said cabinet and being positioned between said top and bottom sides; and each of said front drawers is positioned between said shelf and said bottom side, each of said front drawers extending outwardly through said forward side of said cabinet when said front drawers are opened.

5. The assembly according to claim 4, wherein each of said dispensers having a dispensing nozzle and a pump, said pump on each of dispensers being configured to be manipulated to dispense the personal lubricant from said nozzle on said dispensers.

6. The assembly according to claim 5, further comprising a drip tray being coupled to said shelf, said drip tray being positioned beneath said nozzle on each of said dispensers wherein said drip tray is configured to capture personal lubricant that drips from said nozzle in each of said dispensers, said drip tray being positioned on a forward edge of said shelf.

7. The assembly according to claim 2, further comprising a plurality of first tracks, each of said first tracks being coupled to respective ones of said rear side of said cabinet and said wall in said cabinet, each of said first tracks being horizontally oriented and being positioned in said side drawer space in said cabinet, each of said first tracks being aligned with said opening in said first lateral side of said cabinet.

8. The assembly according to claim 7, further comprising a plurality of second tracks, each of said second tracks being coupled to respective ones of said rear side of said cabinet and said wall in said cabinet, each of said second tracks being horizontally oriented and being positioned in said side drawer space in said cabinet, each of said second tracks being aligned with said opening in said second lateral side of said cabinet.

9. The assembly according to claim 2, wherein each of said side drawers slidably engages a respective pair of said first and second tracks, each of said side drawers being slidably outwardly from said opening in a respective one of said first and second lateral sides of said cabinet, said side drawers being vertically distributed between said top and bottom sides of said cabinet.

10. The assembly according to claim 2, further comprising a pair of doors, each of said doors being hingedly coupled to said cabinet, each of said doors being positioned on a respective one of said first and second lateral sides of said cabinet, each of doors closing said opening in said respective first and second lateral sides when said doors are closed.

11. The assembly according to claim 3, wherein each of said first light emitters is positioned within said cabinet, each of said first light emitters being directed toward said forward side of said cabinet, said first light emitters being horizontally distributed along said wall in said cabinet.

12. The assembly according to claim 2, wherein each of said second light emitters is positioned on said bottom side of said cabinet wherein each of said second light emitters is configured to emit light downwardly onto the support surface, said second light emitters being spaced apart from each other and being distributed around a perimeter of said bottom side.

13. The assembly according to claim 2, further comprising a power supply being coupled to said cabinet, each of said towel warmer, said first light emitters, said second light emitters, said speakers and said subwoofer being electrically coupled to said power supply, said power supply being positioned on said rear side of said cabinet, said power supply having a plurality of female electrical outlets thereon, said power supply having a plurality of charge ports being recessed therein for charging electronic devices, said power supply being electrically coupled to a power source comprising a female electrical outlet.

14. An adult product storage assembly being configured to store personal lubricants and adult toys, said assembly comprising:

a cabinet having a forward side, a rear side, a top side, a bottom side, a first lateral side and a second lateral side, said forward side being open to access an interior of said cabinet, each of said first and second lateral sides having an opening extending into said interior of said cabinet, said opening on each of said first and second lateral sides extending between said top and bottom sides, said opening in each of said first and second lateral sides being aligned with said rear side;

a plurality of rollers, each of said rollers being coupled to said cabinet wherein each of said rollers is configured to roll along a support surface, each of said rollers being positioned on said bottom side of said cabinet;

a wall being positioned within said cabinet, said wall being positioned between said forward side and said opening in each of said first and second lateral sides to define an side drawer space between said wall and said rear side of said cabinet;

a shelf being positioned in said cabinet, said shelf being horizontally oriented in said cabinet and being positioned between said top and bottom sides;

a pair of front drawers, each of said front drawers being slidably positioned in said cabinet wherein each of said front drawers is configured to store objects, each of said front drawers being positioned between said shelf and said bottom side, each of said front drawers extending outwardly through said forward side of said cabinet when said front drawers are opened;

a plurality of dispensers each being configured to store a personal lubricant, each of said dispensers being positioned on said shelf, each of said dispensers having a dispensing nozzle and a pump, said pump on each of dispensers being configured to be manipulated to dispense the personal lubricant from said nozzle on said dispensers wherein each of dispensers is configured to dispense the personal lubricant for a user;

a drip tray being coupled to said shelf, said drip tray being positioned beneath said nozzle on each of said dispensers wherein said drip tray is configured to capture personal lubricant that drips from said nozzle in each of said dispensers, said drip tray being positioned on a forward edge of said shelf;

a plurality of first tracks, each of said first tracks being coupled to respective ones of said rear side of said cabinet and said wall in said cabinet, each of said first tracks being horizontally oriented and being positioned in said side drawer space in said cabinet, each of said first tracks being aligned with said opening in said first lateral side of said cabinet;

a plurality of second tracks, each of said second tracks being coupled to respective ones of said rear side of said cabinet and said wall in said cabinet, each of said second tracks being horizontally oriented and being positioned in said side drawer space in said cabinet, each of said second tracks being aligned with said opening in said second lateral side of said cabinet;

a plurality of side drawers, each of said side drawers being slidably coupled to said cabinet, each of said side drawers being slidable outwardly from said cabinet for accessing each of said side drawers, each of said side drawers being recessable into said cabinet for storing said side drawers, each of said side drawers slidably engaging a respective pair of said first and second tracks, each of said side drawers being slidably outwardly from said opening in a respective one of said first and second lateral sides of said cabinet, said side drawers being vertically distributed between said top and bottom sides of said cabinet;

a pair of doors, each of said doors being hingedly coupled to said cabinet, each of said doors being positioned on a respective one of said first and second lateral sides of said cabinet, each of doors closing said opening in said respective first and second lateral sides when said doors are closed;

a towel warmer being coupled to said cabinet wherein said towel warmer is configured to contain and warm towels, said towel warmer being recessed into said forward side;

a towel door being hingedly coupled to said top side of said cabinet along a distal edge of said towel door relative to a front edge of said top side wherein said towel door opens facing said front edge of said top side of said cabinet;

a pair of speakers, each of said speakers being coupled to said cabinet wherein each of said speakers is configured to emit audible sound outwardly therefrom, each of said speakers being recessed into said top side of said cabinet, each of said speakers being positioned on opposite sides of said towel warmer from each other, a subwoofer being positioned in said cabinet wherein said subwoofer is configure to emit audible sounds at the lower frequency range of human hearing;

a plurality of first light emitters, each of said first light emitters being coupled to said cabinet wherein each of said first light emitters is configured to emit light outwardly therefrom, each of said first light emitters being positioned within said cabinet, each of said first light emitters being directed toward said forward side of said cabinet, said first light emitters being horizontally distributed along said wall in said cabinet;

a plurality of second light emitters, each of said second light emitters being coupled to said cabinet wherein each of said second light emitters is configured to emit light outwardly therefrom, each of said second light emitters being positioned on said bottom side of said cabinet wherein each of said second light emitters is configured to emit light downwardly onto the support surface, said second light emitters being spaced apart from each other and being distributed around a perimeter of said bottom side; and a power supply being coupled to said cabinet, each of said towel warmer, said first light emitters, said second light emitters, said speakers and said subwoofer being electrically coupled to said power supply, said power supply being positioned on said rear side of said cabinet, said power supply having a plurality of female electrical outlets thereon, said power supply having a plurality of charge ports being recessed therein for charging electronic devices, said power supply being electrically coupled to a power source comprising a female electrical outlet.

* * * * *